US006325741B1

(12) United States Patent
Kawai

(10) Patent No.: US 6,325,741 B1
(45) Date of Patent: Dec. 4, 2001

(54) THROTTLE VALVE CONTROL APPARATUS AND METHOD FOR INTERNAL COMBUSTION ENGINE

(75) Inventor: Katsuyuki Kawai, Higashikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/610,304

(22) Filed: Jul. 5, 2000

(30) Foreign Application Priority Data

Jul. 22, 1999 (JP) ..... 11-208277

(51) Int. Cl.[7] ..... F02D 29/00
(52) U.S. Cl. ..... 477/111; 123/399
(58) Field of Search ..... 477/107, 111, 477/112, 113; 123/399

(56) References Cited

U.S. PATENT DOCUMENTS 4,461,254 * 7/1984 Pfalzgraf et al. ..... 123/399 X
4,881,428 * 11/1989 Ishigawa et al. ..... 477/111 X

FOREIGN PATENT DOCUMENTS

01244140-A * 9/1989 (JP) .
7-26581 3/1995 (JP) .
10-299546 11/1998 (JP) .

* cited by examiner

*Primary Examiner*—Charles A Marmor
*Assistant Examiner*—Ankur Parekh
(74) *Attorney, Agent, or Firm*—Oliff & Berridge PLC

(57) ABSTRACT

A throttle valve control apparatus for an internal combustion engine curbs the degree of opening of a throttle valve in accordance with the state of a transmission connected to a crankshaft of the engine and/or the state of operation of the vehicle. Normally, the control apparatus controls the throttle valve opening amount to a target throttle opening amount that is set based on the amount of depression of an accelerator pedal and the engine revolution speed. When the transmission is in a neutral state or when the vehicle is in a stopped state, a target throttle opening amount is set independently of the engine revolution speed.

26 Claims, 3 Drawing Sheets

THROTTLE VALVE CONTROL APPARATUS AND METHOD FOR INTERNAL COMBUSTION ENGINE

INCORPORATION BY REFERENCE

The disclosure of Japanese Patent Application No. 11-208277 filed on Jul. 22, 1999 including the specification, drawings and abstract is incorporated herein by reference in its entirety.

BACKGROUND OF THE INVENTION

1. Field of the Invention

The present invention relates to a throttle valve control apparatus and to a throttle valve control method for an internal combustion engine, wherein a throttle valve is opened and closed by an actuator.

2. Description of Related Art

In a vehicle control apparatus described in, for example, Japanese Patent Application Laid-Open No. 10-299546, a throttle valve is opened and closed by an actuator. In this apparatus, a target throttle opening amount is set based on the accelerator operation amount and the revolution speed of an internal combustion engine. The degree of opening of the throttle valve is controlled so as to become equal to the target throttle opening amount. Furthermore, based on the position of the throttle valve in the opening/closing direction, the apparatus determines whether the engine is idling. If the engine is in the idle state, the apparatus substantially fixes the throttle valve in position, thereby stabilizing the revolution speed of the engine in the idle state.

In the apparatus described above, however, if the accelerator is depressed, even if depressed slightly, during the idle state, the throttle valve is opened, that is, the throttle valve is shifted away from a completely closed position. As a result, the apparatus determines that the engine is not in the idle state. Once it is determined that the engine is not in the idle state, the apparatus increases the target throttle opening amount with increases in the engine revolution speed, so that the throttle valve is further opened and, therefore, the engine revolution speed further increases. If the load on the engine is small in this situation, the throttle valve is gradually opened so that the engine revolution speed greatly increases, thus discomforting a driver of the vehicle.

SUMMARY OF THE INVENTION

Accordingly, it is an object of the invention to provide a throttle valve control apparatus for an internal combustion engine that is capable of preventing an unnecessary increase in the revolution speed of the engine by curbing the opening of the throttle valve when there is no need to greatly increase the engine revolution speed (that is, for example, when a transmission connected to a crankshaft of the engine is in the NEUTRAL state, or when the vehicle is in a stopped state, or the like).

To achieve the aforementioned and/or other objects, a throttle valve control apparatus for an internal combustion engine in accordance with one aspect of the invention includes a throttle opening amount controller that sets a target throttle opening amount of a throttle valve based on at least one of an accelerator operation amount and a revolution speed of the internal combustion engine, a shift position detector that detects a shift position of a transmission connected to a crankshaft of the internal combustion engine, and a vehicle speed detector that detects a vehicle speed of a vehicle equipped with the internal combustion engine.

The throttle opening amount controller sets the target throttle opening amount based only on the accelerator operation amount, in at least one of a case where the shift position detected by the shift position detector is a neutral position and a case where the vehicle speed detected by the vehicle speed detector is zero.

Therefore, even if an accelerator pedal is depressed so that the revolution speed of the internal combustion engine increases while the vehicle is in the stopped state or while the transmission is in the neutral state, an increase in the target throttle opening amount in response to the increase in the engine revolution speed is prevented. Hence, unnecessary increases in the engine revolution speed can be curbed.

In this aspect of the invention, the target throttle opening amount may be gradually changed from a target throttle opening amount based only on the accelerator operation amount to a target throttle opening amount set based on the accelerator operation amount and the revolution speed of the internal combustion engine, if the vehicle speed is less than a predetermined value (e.g., at the time of transition from the stopped state to a running state of the vehicle, and the like).

Therefore, the throttle valve opening amount is gradually changed, so that a sharp change in the output of the engine can be curbed.

BRIEF DESCRIPTION OF THE DRAWINGS

The foregoing and further objects, features and advantages of the present invention will become apparent from the following description of a preferred embodiment with reference to the accompanying drawings, wherein like numerals are used to represent like elements and wherein.

DETAILED DESCRIPTION OF PREFERRED EMBODIMENT

A preferred embodiment of the invention will be described in detail hereinafter with reference to the accompanying drawings.

Figure 1:
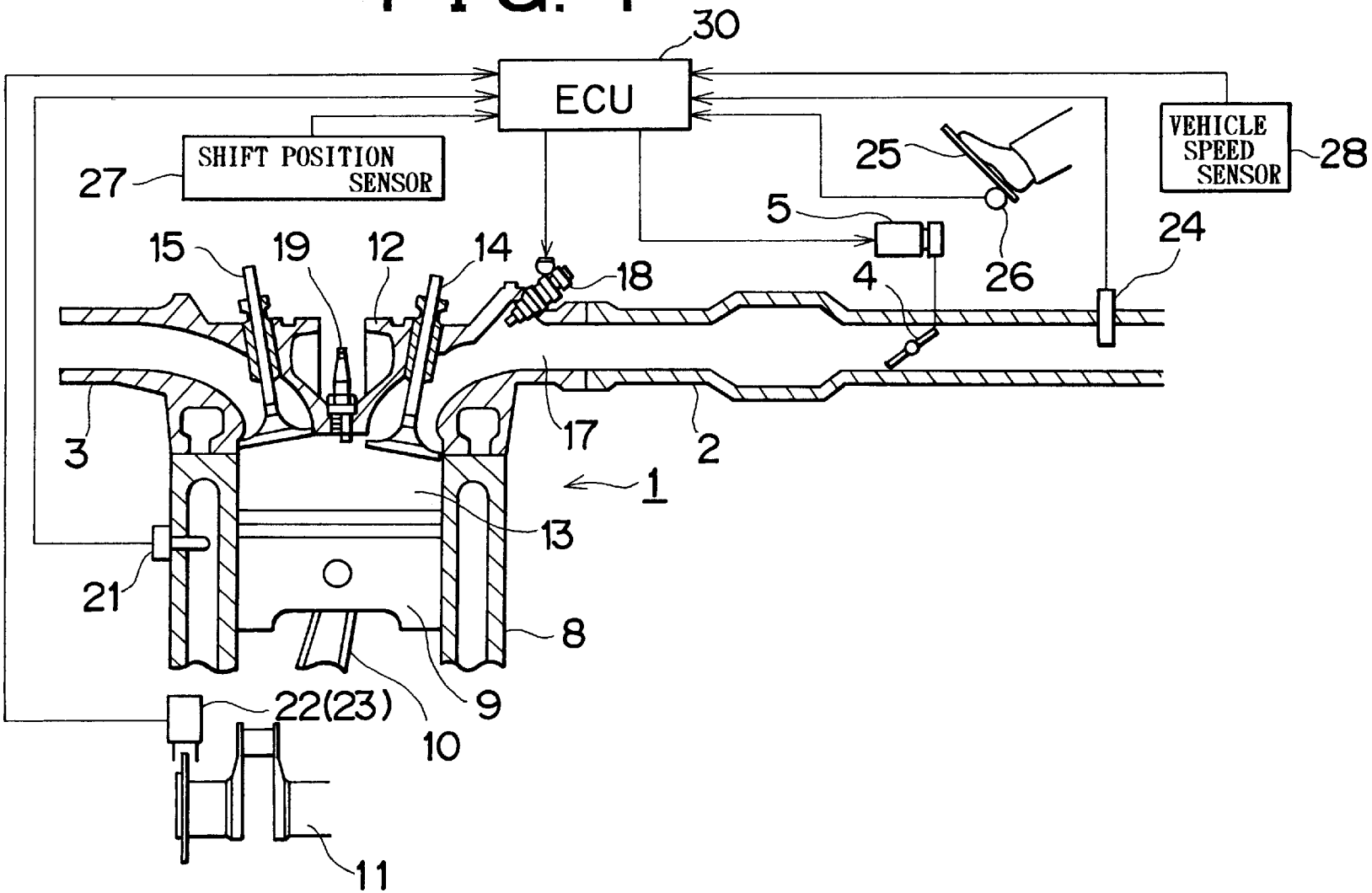
FIG. 1 is a block diagram illustrating a throttle control apparatus according to an embodiment of the invention.

FIG. 1 is a block diagram of one preferred embodiment of the throttle control apparatus of the invention. Referring to FIG. 1, an internal combustion engine (hereinafter, simply referred to as "engine") 1 is a drive power source of a vehicle. The amount of air taken into the engine 1 is adjusted based on the degree of opening of a throttle valve 4. The opening of the throttle valve 4 is adjusted by a throttle actuator 5 that is an electronically controlled actuator in this embodiment.

A piston 9 is disposed in a cylinder 8 of the engine 1 so that the piston 9 can reciprocate in vertical directions in FIG. 1. The piston 9 is connected to a crankshaft 11 by a connecting rod 10. A combustion chamber 13 is defined by an upper end of the piston 9, the cylinder 8 and a cylinder head 12. The combustion chamber 13 communicates with an intake pipe 2 and an exhaust pipe 3 via an intake valve 14 and an exhaust valve 15, respectively.

An intake port 17 of the engine 1 is provided with an electromagnetic drive type injector 18. The injector 18 is supplied with fuel (gasoline) from a fuel tank (not shown). Air supplied from the intake pipe 2 and fuel injected from the injector 18 mix in the intake port 17, and the air-fuel mixture flows into the combustion chamber 13 (an internal space of the cylinder 8) when the intake valve 14 is opened. After being introduced into the combustion chamber 13, the air-fuel mixture is compressed therein, and then is ignited to explode by an ignition spark from an ignition plug 19. The explosion provides a torque for the engine 1. After combustion, resultant gas is discharged as exhaust gas into the exhaust pipe 3 via the exhaust valve 15.

The cylinder 8 is provided with a water temperature sensor 21 for detecting the temperature of cooling water located in a water jacket of the cylinder 8. The crankshaft 11 is provided with a reference position sensor 22 that outputs a pulse signal at every 720° C. A (crank angle) in accordance with the state of rotation of the crankshaft 11, and a revolution speed sensor 23 that outputs a pulse signal at every predetermined crank angle (e.g., every 30° C.A).

An upstream portion of the intake pipe 2 is provided with an air flow meter 24 for detecting the amount of intake air. An accelerator pedal 25 that is depressed by a driving person is provided with an accelerator sensor 26 for detecting the amount of depression of the accelerator pedal 25. A transmission (not shown) is provided with a shift position sensor 27 that detects the shift position of the transmission. A propeller shaft (not shown) that transmits torque to drive wheels of the vehicle is provided with a vehicle speed sensor 28 that detects the rotation speed of the propeller shaft (indicating the vehicle speed).

An ECU (Electronic Control Unit) 30 is formed mainly by a microcomputer that has a CPU, a ROM, a RAM, an I/O circuit, and the like. The ECU 30 inputs detection signals from the water temperature sensor 21, the reference position sensor 22, the revolution speed sensor 23, the air flow meter 24, the accelerator sensor 26, the shift position sensor 27, and the vehicle speed sensor 28. Based on the various detection signals, the ECU 30 detects the engine water temperature, the crank angle, the engine revolution speed, the amount of intake air, the amount of accelerator operation, the shift position, and the vehicle speed.

Furthermore, based on the detection outputs of the aforementioned sensors, the ECU 30 calculates a fuel injection amount (fuel injection duration), an ignition timing, a target throttle opening amount, and the like, and controls the fuel injection performed by the injector 18, the ignition performed by the ignition plug 19, and the opening of the throttle valve 4 driven by the throttle actuator 5.

During normal running of the vehicle, the ECU 30 determines a target throttle opening amount based on the amount of accelerator operation detected by the accelerator sensor 26, and the engine revolution speed detected by the revolution speed sensor 23. By controlling the driving of the throttle actuator 5, the ECU 30 adjusts the opening of the throttle valve 4 to the target throttle opening amount. Since the ECU 30 determines the target throttle opening amount based on the engine revolution speed as well as the amount of accelerator operation, and adjusts the opening of the throttle valve 4 to the target throttle opening amount as described above, the throttle response can be improved.

When the transmission connected to the crankshaft 11 of the engine 1 is in the NEUTRAL state, or when the vehicle speed is zero, that is, when there is no need for a great increase in the engine revolution speed, a target throttle opening amount is set independently of the engine revolution speed, so that the opening of the throttle valve 4 is curbed and an unnecessary increase in the engine revolution speed is curbed.

Figure 2:
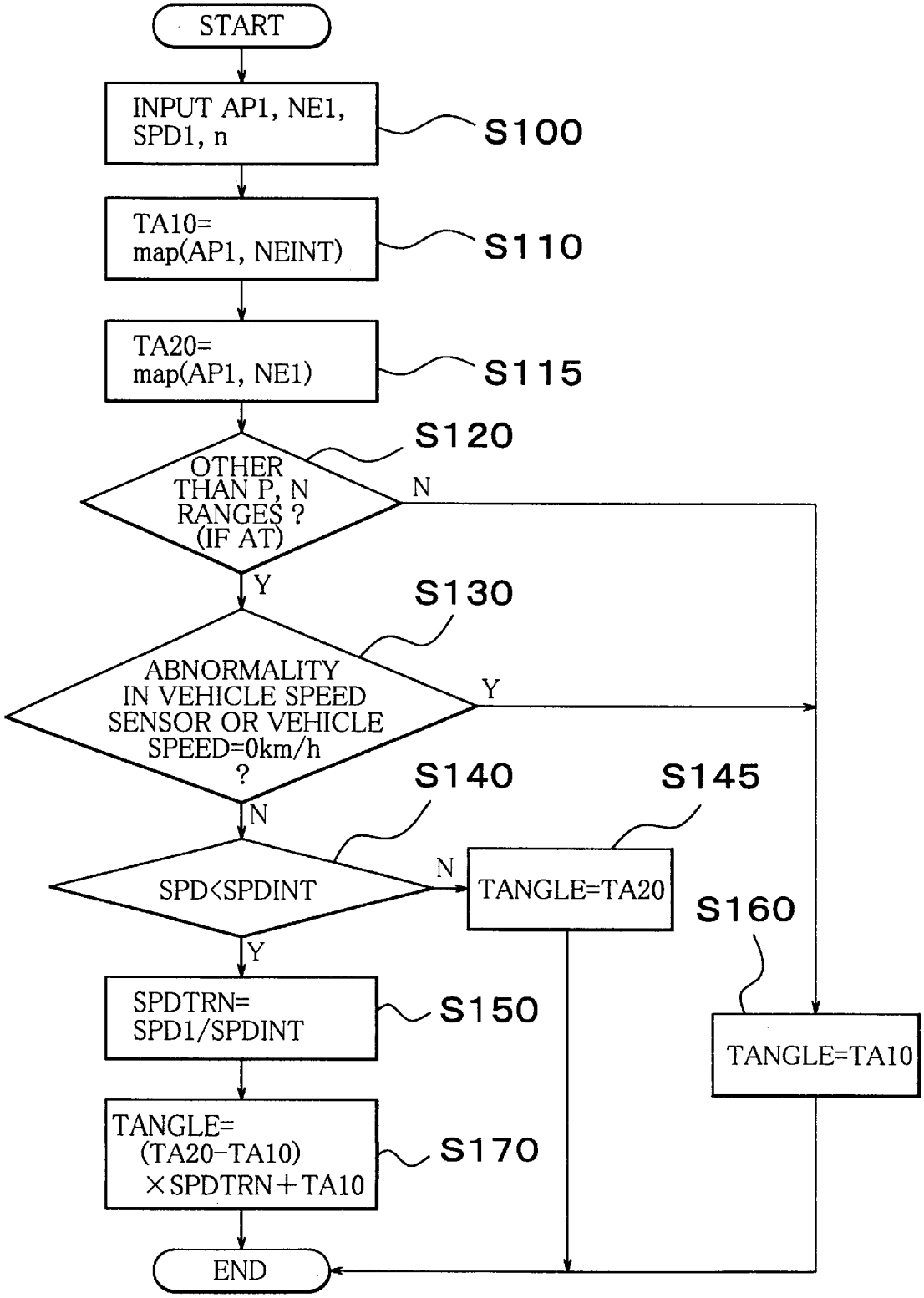
FIG. 2 is a flowchart illustrating an operation performed by the throttle control apparatus shown in FIG. 1.

The control of opening and closing the throttle valve 4 will be described in detail with reference to the flowchart of FIG. 2.

First, the ECU 30 inputs the accelerator operation amount AP1 detected by the accelerator sensor 26, the engine revolution speed NE1 detected by the revolution speed sensor 23, the vehicle speed SPD1 detected by the vehicle speed sensor 28, and the shift position n of the transmission detected by the shift position sensor 27 (step S100).

Subsequently, the ECU 30 determines a tentative target throttle opening amount corresponding to the accelerator operation amount AP1, based on a data map MPi (i=1, 2, . . . , n) that corresponds to the shift position n.

The data map MPi corresponding to the shift position n is pre-stored in a storage device (e.g., ROM ) of the ECU 30. More specifically, data maps MP1, MP2, . . . , MPn corresponding to n number of shift positions of the transmission are pre-stored in a storage device (e.g., ROM) of the ECU 30. The ECU 30 selects a data map corresponding to the shift position detected by the shift position sensor 27, from the data maps MPi.

The data maps MPi do not include data maps that are set specifically corresponding to the NEUTRAL position and the PARKING position of the transmission. Therefore, when the shift position of the transmission is the NEUTRAL position or the PARKING position (in the case of a manual transmission, only the NEUTRAL position), a suitable one of the data maps MPi is used as a substitute.

In each one of the data maps MPi, the characteristics S1, S2, . . . , Sm of the tentative target throttle opening amount corresponding to the accelerator operation amount AP1 are set separately for different engine revolution speeds NE. In addition to these characteristics, a characteristic S0 independent of the engine revolution speed NE is set. The target throttle opening amount corresponding to the characteristic S0 independent of the engine revolution speed NE is set lower than the characteristics S1, S2, . . . , Sm set separately for the different engine revolution speeds NE.

The ECU 30 determines a first tentative target throttle opening amount TA10 corresponding to the accelerator operation amount AP1 detected by the accelerator sensor 26, by referring to the characteristic S0 (step S110). That is, the ECU 30 tentatively sets a target throttle opening amount based only on the accelerator operation amount, independently of the engine revolution speed.

The ECU 30 selects a data map MPn corresponding to the shift position n, and selects, from the characteristics S1, S2, . . . , Sm of the engine revolution speed NE provided in the data map Mpn, a characteristic corresponding to the engine revolution speed NE1 detected by the revolution speed sensor 23. For example, if the engine revolution speed NE1 detected by the revolution speed sensor 23 is 1,000 rpm, the characteristic S1 is selected. With reference to the characteristic S1, the ECU 30 determines a second tentative target throttle opening amount TA20 corresponding to the accelerator operation amount AP1 detected by the accelerator sensor 26 (step S115).

Figure 3:
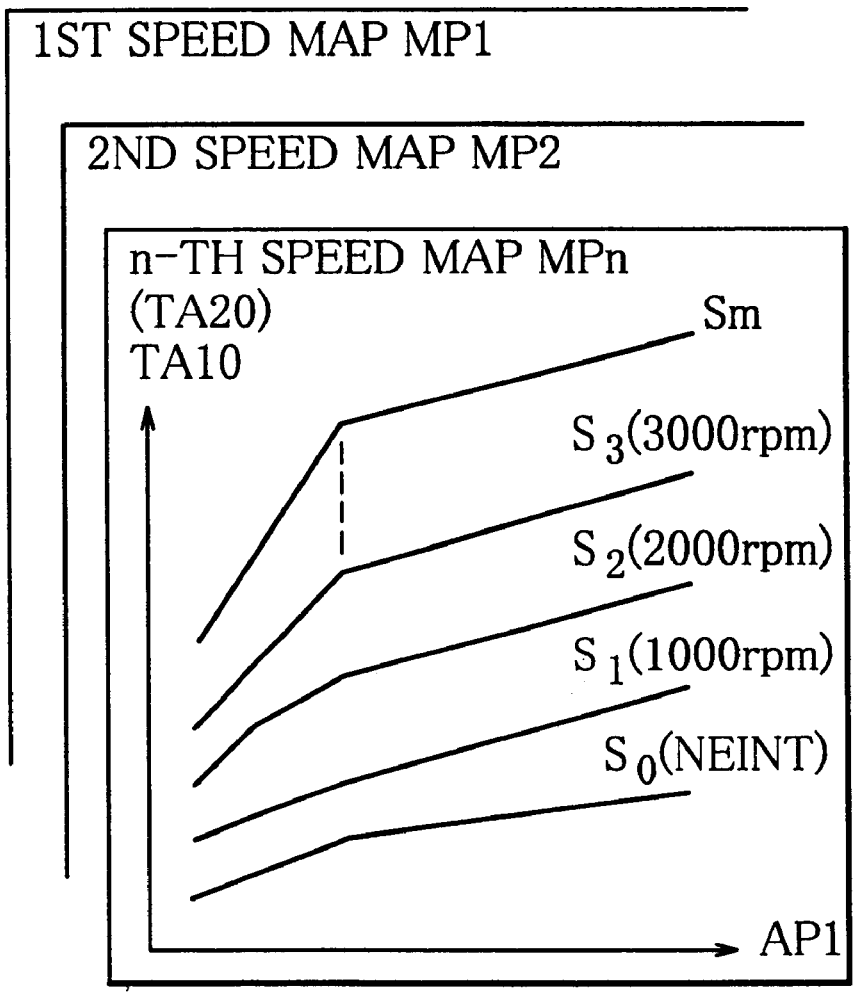
FIG. 3 indicates data maps stored in an ECU of the throttle control apparatus shown in FIG. 1.

If the engine revolution speed NE1 detected by the revolution speed sensor 23 is a value between two adjacent revolution speeds set corresponding to characteristics in the data map, the ECU 30 selects the two characteristics, and determines a characteristic of the engine revolution speed NE1 by interpolation with respect to the two characteristics. With reference to the thus-determined characteristic, the ECU 30 determines a second tentative target throttle opening amount TA20 corresponding to the detected accelerator operation amount AP1. For example, if the detected engine revolution speed NE1 is 1,500 rpm, the corresponding characteristic is determined by referring to the characteristic S1 (1,000 rpm) and the characteristic S2 (2,000 rpm) set in the data map as illustrated in FIG. 3.

Subsequently, the ECU 30 determines, if the transmission is of an automatic type, whether the shift position is either one of the PARKING position and the NEUTRAL position (if the transmission is of a manual type, the ECU 30 determines whether the shift position is the NEUTRAL position) (step S120).

When the shift position is not the PARKING or NEUTRAL position (YES in step S120), the ECU 30 then determines whether the vehicle speed sensor 28 has an abnormality, and determines whether the vehicle speed SPD1 detected by the vehicle speed sensor 28 is zero (step S130). The determination as to whether the vehicle speed sensor 28 has an abnormality is performed by, for example, calculating a vehicle speed from the shift position detected by the shift position sensor 27 and the engine revolution speed detected by the revolution speed sensor 23, and comparing the calculated vehicle speed with the vehicle speed SPD1 detected by the vehicle speed sensor 28.

When the operation of the vehicle speed sensor 28 is normal and the detected vehicle speed SPD1 is not zero (NO in step S130), the ECU 30 determines whether the vehicle speed SPD1 detected by the vehicle speed sensor 28 is less than a pre-set threshold SPDINT (step S140).

If the vehicle speed SPD1 is greater than or equal to the threshold SPDINT (NO in step S140), the ECU 30 sets the second tentative target throttle opening amount TA20 determined in step S115, as a target throttle opening amount TANGLE (step S145) Then, the ECU 30 adjusts the opening of the throttle valve 4 to the target throttle opening amount TANGLE by controlling the driving of the throttle actuator 5.

During normal running of the vehicle, the shift position is set to a position that is other than the NEUTRAL position and the PARKING position (YES in step S120). If the vehicle speed sensor 28 does not have an abnormality and the vehicle speed SPD1 is sufficiently high, the ECU 30 selects the second tentative target throttle opening amount TA20 determined based on the characteristic corresponding to the engine revolution speed NE1 in the data map corresponding to the shift position of the transmission. Then, the ECU 30 controls the opening of the throttle valve 4 to the second tentative target throttle opening amount TA20. In short, the opening of the throttle valve 4 is adjusted in accordance with the accelerator operation amount AP1 detected by the accelerator sensor 26 and the engine revolution speed detected by the revolution speed sensor 23. Therefore, good throttle response is achieved.

When the vehicle is not in the normal running state, that is, when the shift position of the transmission is set to the PARKING or NEUTRAL position (NO in step S120), or when the vehicle speed sensor 28 has an abnormality or the vehicle speed SPD1 is zero (YES in step S130), the ECU 30 sets the first tentative target throttle opening amount TA10 determined in step S110 as a target throttle opening amount TANGLE (step S160) Then, by controlling the driving of the throttle actuator 5, the ECU 30 adjusts the opening of the throttle valve 4 to the target throttle opening amount TANGLE.

That is, when there is no need for a great increase in the engine revolution speed, or when it is impossible to determine whether there is a need for a great increase in the engine revolution speed, the ECU 30 selects the first tentative target throttle opening amount TA10 determined based on the characteristic S0 set in the data map independently of the engine revolution speed NE. Therefore, the opening of the throttle valve 4 is set independently of the engine revolution speed NE. As a result, even if the accelerator pedal 25 is depressed so that the engine revolution speed increases, the opening of the throttle valve 4 is not further expanded with the increase in the engine revolution speed. Hence, the engine revolution speed is controlled at a low speed and is stabilized.

A control operation performed at the time of transition from the stopped state (where the vehicle speed SPD1 is zero) to the normal running state of the vehicle will be described. In this case, the shift position of the transmission is set to a position that is other than the PARKING position and the NEUTRAL position (YES in step S120), and the vehicle speed SPD1 is not zero (NO in step S130). Then, if the vehicle speed SPD1 is less than the threshold SPDINT (YES in step S140) , the ECU 30 determines a vehicle speed ratio SPDTRN (=SPD1/SPDINT) of the vehicle speed SPD1 to the threshold SPDINT (step S150), and determines a target throttle opening amount TANGLE as in equation (1) (step S170).

$$TANGLE=(TA20-TA10)\times SPDTRN+TA10 \quad (1)$$

According to equation (1), when the vehicle speed SPD1 is close to zero (immediately after the transition to the normal running), the value of the target throttle opening amount TANGLE becomes close to the first tentative target throttle opening amount TA10. As the vehicle speed SPD1 approaches the threshold SPDINT (as the vehicles speed increases), the target throttle opening amount TANGLE approaches the second tentative target throttle opening amount TA20.

That is, at the time of transition from the stopped state to the normal running state of the vehicle, the target throttle opening amount TANGLE is gradually increased from the vicinity of the first tentative target throttle opening amount TA10 to the second tentative target throttle opening amount TA20. Therefore, the opening of the throttle valve 4 is not sharply changed, so that the output torque of the engine 1 is gradually increased.

As is apparent from the above-description, according to the invention, a target throttle opening amount is set without taking into consideration the revolution speed of the internal combustion engine, when the transmission is in the neutral state or when the vehicle is in the stopped state. Therefore, even if the throttle valve is driven in the opening direction in response to a slight depression of the accelerator pedal so that the revolution speed of the engine increases, the target throttle opening amount is not increased in response to the increase in the engine revolution speed, so that a great increase in the engine revolution speed is avoided.

Furthermore, at the time of transition from the stopped state to the normal running state of the vehicle, the target value of the throttle opening amount is gradually changed from a value that is set independently of the engine revolution speed to a value that is set based on the accelerator operation amount and the engine revolution speed. Therefore, the throttle valve opening amount is gradually changed, so that a sharp change in the output of the engine is avoided.

Still further, if there is an abnormality in relation to the determination as to whether the transmission is in the neutral state or the determination as to whether the vehicle is in the stopped state, a target throttle opening amount is set independently of the engine revolution speed. Therefore, a great increase in the engine revolution speed at the time of occurrence of an abnormality is substantially prevented.

In the illustrated embodiment, the controller (ECU 30) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller also can be a plurality of separate dedicated or programmable integrated or other electronic circuits or devices (e.g., hard-wired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the flowcharts shown in FIG. 2 can be used as the controller. A distributed processing architecture can be used for maximum data/signal processing capability and speed.

While the invention has been described with reference to preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. A throttle valve control apparatus for an internal combustion engine, comprising:

a throttle opening amount controller that sets a target throttle opening amount of a throttle valve based on at least one of an accelerator operation amount and a revolution speed of the internal combustion engine;

a shift position detector that detects a shift position of a transmission connected to a crankshaft of the internal combustion engine; and a vehicle speed detector that detects a vehicle speed of a vehicle equipped with the internal combustion engine, wherein the throttle opening amount controller sets the target throttle opening amount based only on the accelerator operation amount when at least one of the following two conditions exists:

the shift position detected by the shift position detector is a neutral position, and the vehicle speed detected by the vehicle speed detector is zero.

2. A control apparatus according to claim 1, wherein the throttle opening amount controller gradually changes the target throttle opening amount from a target throttle opening amount based only on the accelerator operation amount to a target throttle opening amount set based on the accelerator operation amount and the revolution speed of the internal combustion engine, when the vehicle speed detected by the vehicle speed detector is greater than zero and less than a predetermined value.

3. A control apparatus according to claim 1, wherein the throttle opening amount controller determines whether an operation of the vehicle speed detector is abnormal based on a value detected by the vehicle speed detector, and sets the target throttle opening amount to the target throttle opening amount based only on the accelerator operation amount when it is determined that the operation of the vehicle speed detector is abnormal.

4. A control apparatus according to claim 1, wherein the neutral position includes a park position.

5. A control apparatus according to claim 1, wherein the throttle opening amount controller gradually changes the target throttle opening amount from a target throttle opening amount based only on the accelerator operation amount to a target throttle opening amount set based on the accelerator operation amount and the revolution speed of the internal combustion engine, at the time of transition from a stopped state to the normal running state of the vehicle.

6. A control apparatus according to claim 1, wherein the throttle opening amount controller monitors whether at least one of operations of the shift position detector and the vehicle speed detector are abnormal, and wherein the throttle opening amount controller sets the target throttle opening amount to the target throttle opening amount based only on the accelerator operation amount when it is determined that at least one of the operation of the shift position detector and the operation of the vehicle speed detector is abnormal.

7. A throttle valve control method for an internal a combustion engine, comprising:

setting a first target throttle opening amount based on an accelerator operation amount;

setting a second target throttle opening amount based on the accelerator operation amount and a revolution speed of the internal combustion engine;

detecting a shift position of a transmission connected to a crankshaft of the internal combustion engine;

detecting a vehicle speed of a vehicle equipped with the internal combustion engine; and controlling the throttle valve based on the first target throttle opening amount when at least one of the following two conditions exists:

the detected shift position is a neutral position, and the detected vehicle speed is zero.

8. A control method according to claim 7, further comprising:

comparing the detected vehicle speed with a predetermined value; and changing the throttle valve gradually from the first target throttle opening amount to the second target throttle opening amount when the detected vehicle speed is greater than zero and less than the predetermined value.

9. A control method according to claim 7, further comprising:

determining whether the detected vehicle speed is within a predetermined range; and setting the throttle valve opening amount to the first target throttle opening amount when the detected vehicle speed is out of the predetermined range.

10. A control method according to claim 9, the predetermined range is determined based on the detected shift position.

11. A control method according to claim 7, wherein the neutral position includes a park position.

12. A control method according to claim 7, further comprising:

determining a state of the vehicle; and changing the throttle valve gradually from the first target throttle opening amount to the second target throttle opening amount when the state of the vehicle changes from a stopped state to a normal running state.

13. A control method according to claim 7, further comprising:

determining whether there is failure in the steps of (a) detecting a shift position and (b) detecting a vehicle speed; and setting the throttle valve opening amount to the first target throttle opening amount when it is determined that there is failure in at least one of the steps of (a) detecting a shift position and (b) detecting a vehicle speed.

14. A throttle valve control apparatus for an internal combustion engine, comprising:

a shift position detector that detects a shift position of a transmission connected to a crankshaft of the internal combustion engine;

a vehicle speed detector that detects a vehicle speed of a vehicle equipped with the internal combustion engine; and a throttle opening amount controller that sets a target throttle opening amount of a throttle valve without reference to a revolution speed of the internal combustion engine when at least one of the following two conditions exists:

the shift position detected by the shift position detector is a neutral position, and the vehicle speed detected by the vehicle speed detector is zero.

15. A control apparatus according to claim 14, wherein the throttle opening amount controller gradually changes the target throttle opening amount from a target throttle opening amount determined without reference to the revolution speed of the internal combustion engine to a target throttle opening amount set based on the revolution speed of the internal combustion engine, when the vehicle speed detected by the vehicle speed detector is greater than zero and less than a predetermined value.

16. A control apparatus according to claim 14, wherein the throttle opening amount controller determines whether an operation of the vehicle speed detector is abnormal based on a value detected by the vehicle speed detector, and sets the target throttle opening amount to the target throttle opening amount without reference to the revolution speed of the internal combustion engine when it is determined that the operation of the vehicle speed detector is abnormal.

17. A control apparatus according to claim 14, wherein the neutral position includes a park position.

18. A control apparatus according to claim 14, wherein the throttle opening amount controller gradually changes the target throttle opening amount from a target throttle opening amount based only on the accelerator operation amount to a target throttle opening amount set based on the accelerator operation amount and the revolution speed of the internal combustion engine, at the time of transition from a stopped state to the normal running state of the vehicle.

19. A control apparatus according to claim 14, wherein the throttle opening amount controller monitors whether at least one of operations of the shift position detector and the vehicle speed detector are abnormal, and wherein the throttle opening amount controller sets the target throttle opening amount to the target throttle opening amount based only on the accelerator operation amount when it is determined that at least one of the operation of the shift position detector and the operation of the vehicle speed detector is abnormal.

20. A throttle valve control method for an internal combustion engine, comprising:

setting a first target throttle opening amount without reference to a revolution speed of the internal combustion engine;

setting a second target throttle opening amount based on the revolution speed of the internal combustion engine;

detecting a shift position of a transmission connected to a crankshaft of the internal combustion engine;

detecting a vehicle speed of a vehicle equipped with the internal combustion engine; and controlling the throttle valve based on the first target throttle opening amount when at least one of the following two conditions exists:

the detected shift position is a neutral position, and the detected vehicle speed is zero.

21. A control method according to claim 20, further comprising:

comparing the detected vehicle speed with a predetermined value; and changing the throttle valve gradually from the first target throttle opening amount to the second target throttle opening amount when the detected vehicle speed is greater than zero and less than the predetermined value.

22. A control method according to claim 20, further comprising:

determining whether the detected vehicle speed is within a predetermined range; and setting the throttle valve opening amount to the first target throttle opening amount when the detected vehicle speed is out of the predetermined range.

23. A control method according to claim 22, the predetermined range is determined based on the detected shift position.

24. A control method according to claim 20, wherein the neutral position includes a park position.

25. A control method according to claim 20, further comprising:

determining a state of the vehicle; and changing the throttle valve gradually from the first target throttle opening amount to the second target throttle opening amount when the state of the vehicle changes from a stopped state to a normal running state.

26. A control method according to claim 20, further comprising:

determining whether there is failure in the steps of (a) detecting a shift position and (b) detecting a vehicle speed; and setting the throttle valve opening amount to the first target throttle opening amount when it is determined that there is failure in at least one of the steps of (a) detecting a shift position and (b) detecting a vehicle speed.

* * * * *